United States Patent [19]

Brissier et al.

[11] Patent Number: 4,815,605

[45] Date of Patent: Mar. 28, 1989

[54] AIR TRANSPORT CONTAINER FOR DANGEROUS MATERIALS

[75] Inventors: Raphaël Brissier, Pyla; Christian Gaillard, Gradignan, both of France

[73] Assignee: Commissariat A L'Energie Atomique, Paris, France

[21] Appl. No.: 155,255

[22] Filed: Feb. 12, 1988

[30] Foreign Application Priority Data

Feb. 16, 1987 [FR] France ..... 87 01927

[51] Int. Cl.[4] ..... B65D 81/02; B65D 85/30

[52] U.S. Cl. ..... 206/523; 206/591; 206/594; 206/814; 220/902; 220/68; 220/DIG. 27; 220/468; 250/506.1

[58] Field of Search ..... 206/523, 524, 521, 591–594, 206/814, 68, 902, DIG. 27, 452, 453, 468; 250/506.1, 507.1

[56] References Cited

U.S. PATENT DOCUMENTS

| | | | |
|---|---|---|---|
| 3,608,769 | 9/1971 | Gablin | 220/452 X |
| 3,886,368 | 5/1975 | Rollins et al. | 250/507.1 |
| 4,116,337 | 9/1978 | Backus | 250/506.1 X |
| 4,190,160 | 2/1980 | Anderson et al. | 250/506.1 X |
| 4,423,802 | 1/1984 | Botzem et al. | 206/591 X |
| 4,588,088 | 5/1986 | Allen | 220/902 X |
| 4,627,956 | 12/1986 | Botzem et al. | 220/68 X |

FOREIGN PATENT DOCUMENTS

| | | |
|---|---|---|
| 2454158 | 11/1980 | France . |
| 2082724 | 3/1982 | United Kingdom . |

OTHER PUBLICATIONS

Nuclear Engineering International, vol. 31, No. 389, Dec. 1986, pp. 46–48, W. L. Henkel.

*Primary Examiner*—William Price

*Attorney, Agent, or Firm*—Pearne, Gordon, McCoy & Granger

[57] ABSTRACT

Air transportation container for dangerous materials.

It comprises an internal confinement enclosure (2) containing a quantity of dangerous material (4) and an external confinement enclosure (14) surrounding enclosure (2), the latter having two walls (6) spaced by a shock absorbing material (8), the external confinement enclosure (14) having a wall (18) and a shock absorbing material (20). A cap (24) is located at each of the ends of the external confinement enclosure (14), each cap (24) having at least one mechanically strong outer wall (28) and a layer (30) of a lining material located between the outer wall (28) of cap (24) and external enclosure (14), said caps being mechanically disengaged from the external enclosure (14) and constituting a receptacle containing the external wall (18) following its deformation under the effect of the container impacting with an obstacle (38).

7 Claims, 2 Drawing Sheets

AIR TRANSPORT CONTAINER FOR DANGEROUS MATERIALS

SUMMARY OF THE INVENTION

The present invention relates to a container for the transportation by air of a dangerous material.

Transportation containers for confining a dangerous and in particular radioactive material are already known.

For example, FR-A-No. 2 454 158 (Transuklear) describes a container for the transportation of irradiated fuel elements constituted by a detachable inner container located within an outer container, each container having its own cover. A radioactive material transporation container is also known (Nuclear Engineering International, vol. 31, No. 389, December 1986, pp 46–48) which was intended for the transportation of debris from the core of the reactor of the Three Mile Island nuclear power station. This container comprises an inner enclosure located in a double-walled outer enclosure. The space between these two walls is filled with lead.

Shock absorbers are located at each of the ends of the outer container. They are constituted by a steel sheet and are filled with a polyurethane foam especially designed to bring about the necessary crushing resistance for resisting an impact.

Finally, a cap is known (GB-A-No. 2 082 724, Transnuklear) for protecting each of the ends of a radioactive material transportation container, constituted by an annular part and a bottom lined with a shock absorbing material and formed from a layer of hard wood and a layer of a material of a soft wood, such as balsa.

However, none of these containers is able to satisfy the severe standards imposed for air transport. In particular, when the container has to be transported in an aircraft, a particularly serious problem occurs due to the shock velocity which must be withstood by the container in the case of an accident.

For example, according to the authorization criteria of the U.S. Nuclear Regulatory Commission, a transportation container for transporting a radioactive specimen by air must be able to withstand an impact occurring at a velocity of no less than 130 m/second, occurring at right angles on a flat rigid surface, followed by static compression of 35,000 decanewton by means of a diameter 5 cm steel bar arranged parallel to a flat surface on which the container rests, punching on a steel stake with a load of 250 kg, everything falling 3 m, dropping on the container a steel bar weighing 45 kg from a height of 45 m and with an incidence of 45° with respect to the vertical, a kerosene fire for sixty minutes and finally immersion for eight hours beneath 1 m of water.

It is only that as a result of all these successive tests and without any notable activity release, that the container can be considered as authorized for transportation in an aircraft.

At present, no large capacity container able to satisfy these requirements is known. The containers described hereinbefore are only authorized for transportation by road, where standards are less stringent. Thus, for example, it can be gathered from Nuclear Engineering International, that road standards only require resistance on dropping from a height of 30 feet, whereas in the case of an air transportation container an impact at 130 m/second on an infinitely rigid target is required.

The object of the present invention is to provide a container able to satisfactorily withstand the severe testing requirements imposed for air transportation.

More specifically, the present invention relates to a container for the transportation of a dangerous material comprising an internal confinement enclosure containing a quantity of a dangerous material and having two walls spaced by a shock absorbing material, an external confinement enclosure surrounding the internal confinement enclosure and having a shock absorbing material, a cap being arranged at each of the ends of the external confinement enclosure, each cap having at least one mechanically strong external wall and a layer of material disposed between the external wall of the cap and the external enclosure, characterized in that the layer of material disposed between the external wall of the cap and the external enclosure is a padding or lining layer, said caps are mechanically disengaged from the external enclosure, the padding/lining material pair fulfils a guidance and maintenance function and hoops the deformations of the wall of the external enclosure and the cap constitutes a receptacle containing the external wall following its deformation under the effect of the impact of the container against an obstacle.

The presence of end caps ensures the hooping of the external envelope. The folds and deformations of said envelope at the instant of impact are reduced by the mechanical strength of the double envelope of the cap and remain within the polyurethane foam volume permitting the absorption thereof.

The annular space between the cap and the external enclosure constitutes a receptacle for the deformations of the external enclosure wall. The material used is a lining foam and not a shock absorbing material. Vents are provided so as not to trap the air within said foam. Tests have shown that it was possible to obviate the foam.

Thus, the caps make it possible to maintain the integrity of the external enclosure, in such a way that it has an adequate strength to protect the internal enclosure during the following tests (punching, dropping, kerosene fire). Thus, it is the internal enclosure which must remain tight to prevent any radioactivity release.

Preferably, the lining material is constituted by a foam, whose crushing zone is ten to twelve times less than that of the shock absorbing material.

The invention is described in greater detail hereinafter relative to non-limitative embodiments and the attached drawings, wherein show:

DETAILED DESCRIPTION OF THE PREFERRED EMBODIMENT

Figure 1:
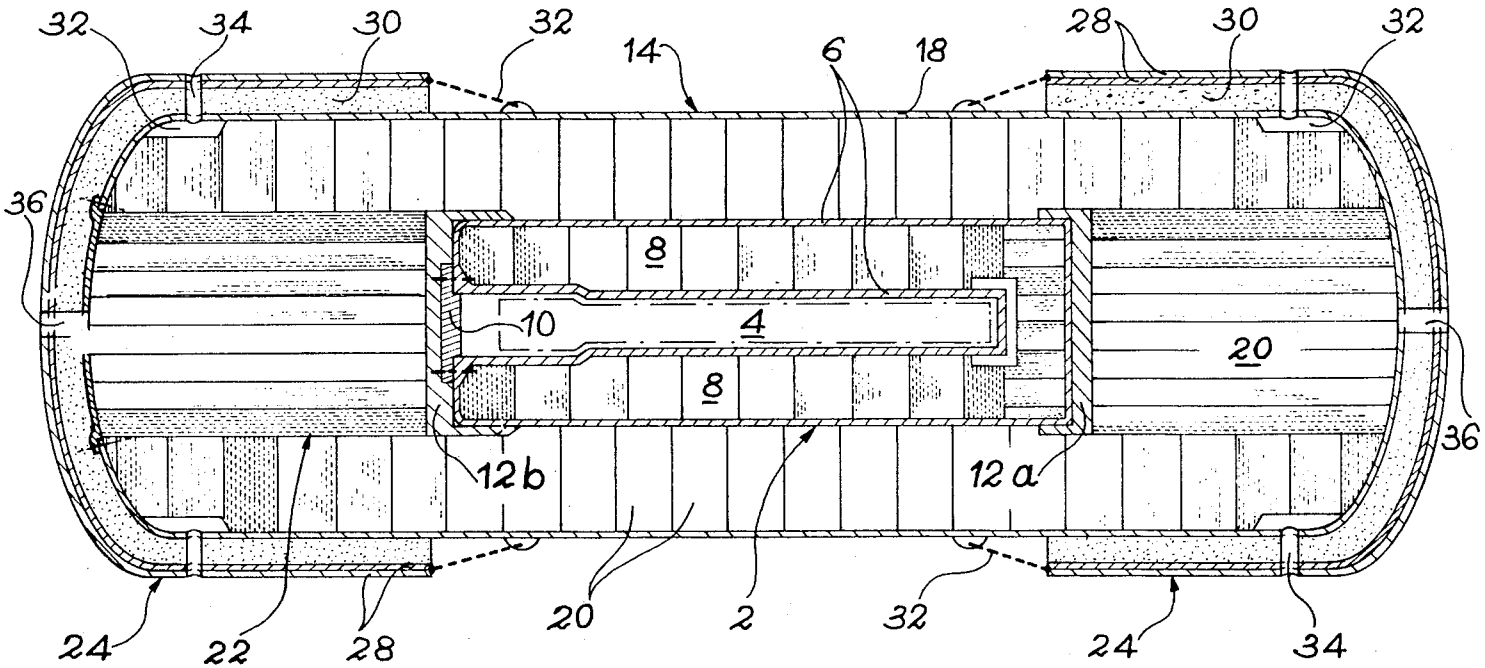
FIG. 1 A longitudinal sectional view of a transportation container according to the invention.

The transportation container is constituted by a confinement enclosure 2 containing a dangerous material, e.g. a radioactive specimen 4, such as an irradiated fuel assembly. The internal confinement enclosure 2 is constituted by two spaced walls 6 made from metal and generally stainless steel with high mechanical characteristics. The space separating the two walls 6 is filled with a shock absorbing material 8, generally of sequoia, balsa or similar wood. The shock absorbing material can also be constituted by a metallic honeycomb structure. The cavity of the internal confinement enclosure containing the radioactive sample 4 is tightly sealed by a plug 10.

The internal confinement enclosure 2 is placed within an external confinement enclosure 14 also constituted by an outer wall 18. A shock absorbing material 20, generally of the same nature as the shock absorbing material 8 of the internal confinement enclosure, is introduced between the external wall 6 of the internal confinement enclosure 2, outer wall 18 of the external confinement enclosure 14.

The thickness of the shock absorbing material 20 and the arrangement of its fibres, in the case where it is made from wood, are determined by calculation so as to absorb the kinetic energy of the assembly impacting on the target.

At each of the ends of the internal confinement enclosure 2 is provided a reinforcement constituted by a thick, rigid and e.g. metallic plate, which is intended to distribute the forces over the internal confinement enclosure 2, which must be able to deform slightly whilst retaining its tight sealing effect. Reinforcement 12*a*, located at the sealed end of enclosure 2 is embedded in the shock absorbing material 20 of the external enclosure 14. Reinforcement 12*b* is put into place after the closure of plug 10.

Following the introduction of the internal confinement enclosure 2, the external confinement enclosure is sealed by a detachable plug 22, which is also made from a shock absorbing material, such as sequoia or balsa wood.

According to the invention, there is a cap 24 at each of the ends of the external confinement enclosure 14. Each of the caps 24 is constituted by an outer double wall 28 and a lining material 30, preferably constituted by polyurethane foam. Each cap 24 is fixed to the external confinement enclosure by an appropriate means, e.g. turnbuckles 32. The latter ensure a good mechanical strength during the assembly and transportation of the container, but play no part at the time of impact.

The two steel sheets 28 constituting the double outer wall are assembled with one another by adhesion, preferably using a flexible epoxy resin adhesive, which ensures better hooping. Polyurethane foam 30 is also adhered to the steel sheets 28 by a flexible epoxy resin adhesive. The function of said foam is to permit radial expansion in the form of folds of the external confinement enclosure 14 and the shock absorbing material contained in the latter when longitudinally compressed on absorbing kinetic shock energy. However, it is not vital for the confinement of the external enclosure 14 to be maintained in the case of shock or impact, provided that the internal container remains completely confined.

Moreover, chambers 22, constituted by annular grooves are formed in the shock absorbing material 20 of the external confinement enclosure at each end of the latter. The function of these chambers is to evacuate the residual air trapped in the external enclosure and which could compress at the time of impact. For this purpose, each of the chambers 32 is linked with the atmosphere outside the container by a series of vents 34 made in the cylindrical wall of the plugs 24, as well as by one or more vents 36 formed in its bottom.

Figure 2:
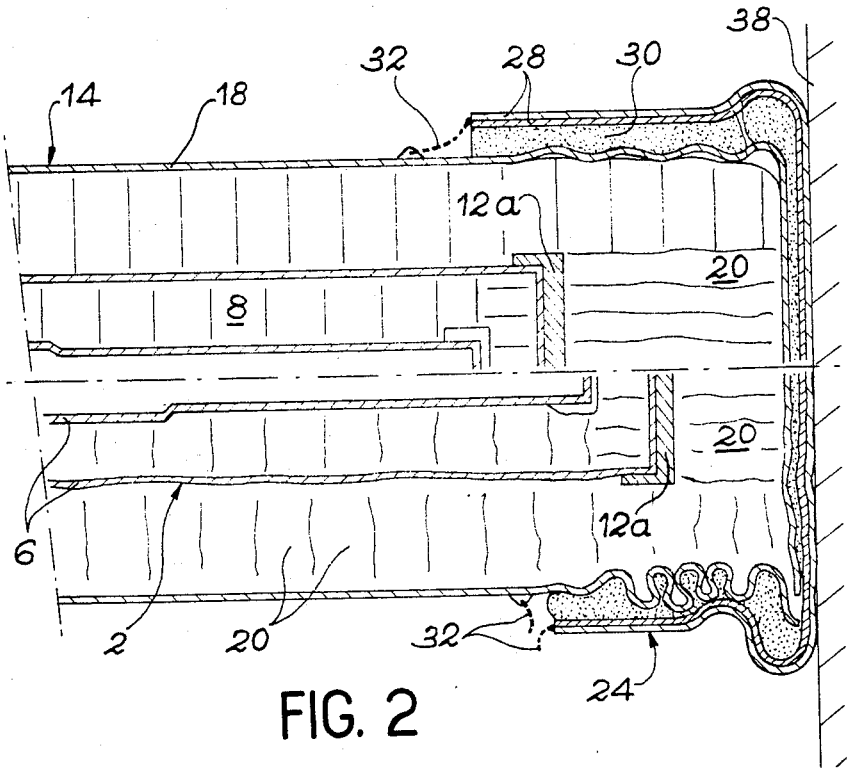
FIG. 2 A view showing the deformation of the container a very short time after impact (upper half-view) and the final deformation of the external container and the cap (lower half-view).

In the upper half of FIG. 2 is shown a half-view in part longitudinal section showing the deformation of the external confinement enclosure very shortly (0.2 millisecond) after an impact occurring at high speed, e.g. 130 m/second, against a hard, rigid obstacle 38. It can be seen that the impact occurs in a direction perpendicular to the surface of the obstacle 38. The layer of insulating material 30 located within cap 24 has been compressed between obstacle 38 and the end of the container. The double wall 28, 28 of cap 4 starts to deform. In the same way, the outer wall 18 of the external confinement enclosure has started to deform under the effect of the impact. However, the lining material 20, which has a higher rigidity than the lining foam 30 is still essentially in its undeformed state.

Moreover, the rods of the turnbuckles 32 have started to bend under the effect of the longitudinal displacement of cap 24 with respect to the external confinement enclosure 14. These rods are designed so as to have a section such that their mechanical strength is low compared with that of the cap and the external enclosure, so that they break just after impact without exerting any significant force or stress on the outer wall 18, or on the double wall 28,28 of the cap. As a result of this feature, there is no stress concentration at the point where the turnbuckle is fixed to the outer wall 18 and the container is not weakened or cracked at this point. The diameter of the turnbuckle rods is designed in such a way as to be adequate to ensure the maintaining in place of the cap during the normal operation of the container, i.e. during its transportation and handling. However, in the case of impact, it must be possible for the cap to move in translation with respect to the external enclosure without any resistance of a significant nature other than the compression of the lining material 30. Thus, the turnbuckles serve as mechanical fuses.

In the lower half-view of FIG. 2 is shown the state of the container after impact. It can be seen that the outer wall of confinement enclosure 14 has undergone marked deformation, but is still contained within the double wall 28,28 of the cap. It can also be seen that the shock absorbing material 20 has been compressed and that the internal confinement enclosure 2 has been displaced to the front end of the container (located towards the rigid obstacle 38).

The function of the lining material 30 has on the one hand been to dampen the shock on the front end of the container and on the other to exert an external compressive force which balances the compressive force exerted on the wall 18 by shock absorbing material 22. Under the effect of the expansion of outer wall 18 within foam 30 there is a hooping effect of cap 24 on the external confinement enclosure 14. Thus, the cap is immobilized by very high forces, so that it is maintained integral with the external confinement enclosure. It therefore remains firmly linked with said enclosure and is not ejected at the time of impact or thereafter. Thus, the cap constitutes a protection for the weakened end of the enclosure for the subsequent testing stages, such as punching, static compression, punching on a steel stake and kerosene fire.

Figure 3:
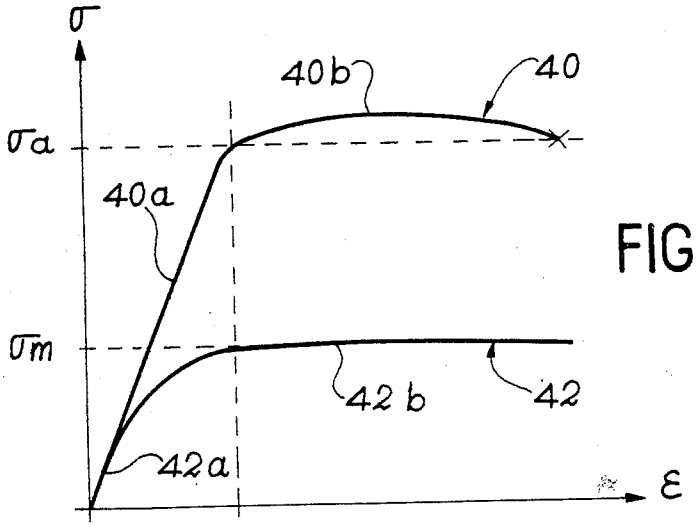
FIG. 3 A curve comparing the values of the crushing zones of the shock absorbing material and the lining material of the cap.

FIG. 3 shows two deformation curves, respectively the deformation curve 40 of the shock absorbing material 20 and the deformation curve 42 of the lining material 30 of cap 24 under the effect of a compressive force $\sigma$. It can be seen that each of these curves has a rectilinear portion 40*a*, 42*a* respectively and a substantially rectilinear zone to axis $\epsilon$ of deformations 40*b*, 42*b*. The rectilinear portions 40*b* and 42*b* are called crushing zones. The values of these crushing zones are characteristics of the material. It can be seen that the crushing zone of the shock absorbing material 20 is significantly higher than that of the foam 30. Preferably, zone $\sigma$ a of the shock absorbing material 20 is ten to twelve times higher than the crushing zone $\sigma$m of the foam 30. It has been found that such a ratio between the crushing zones makes it possible to achieve an optimum result.

We claim:

1. Container for the transportation of a dangerous material comprising an internal confinement enclosure (2) containing a quantity of a dangerous material (4) and having two walls (6) spaced by a shock absorbing material (8), an external confinement enclosure (14) surrounding the internal confinement enclosure (2) and having a shock absorbing material (20), a cap (24) being arranged at each of the ends of the external confinement enclosure (14), each cap (24) having at least one mechanically strong external wall (28) and a layer (30) of material disposed between the external wall (28) of the cap (24) and the external enclosure (14), characterized in that the layer (30) of material disposed between the external wall (28) of the cap (24) and the external enclosure (14) is a padding or lining layer, said caps are mechanically disengaged from the external enclosure (14), the padding/lining material pair fulfils a guidance and maintenance function and hoops the deformations of the wall of the external enclosure and the cap constitutes a receptacle containing the external wall (18) following its deformation under the effect of the impact of the container against an obstacle (38).

2. Container according to claim 1, characterized in that the lining material (30) is constituted by a foam, whose crushing zone is ten to twelve times lower than that of the shock absorbing material (20).

3. Container according to claims 1 or 2, characterized in that it has turnbuckles (32) ensuring the mechanical fixing of caps (24) to the external enclosure when the latter is subject to no exceptional mechanical stress, said turnbuckles having dimensions such that their mechanical strength is low compared with that of the caps (24), so that they behave like mechanical fuses at the time of impact by breaking and without a force being able to have damaging repercussions on the caps (24) and on external enclosure (14).

4. Container according to claim 1, characterized in that each cap (24) has an outer wall constituted by two thicknesses (28,28) assembled to one another by adhesion.

5. Container according to claim 1, characterized in that the lining material layer (30) is adhered to the double outer wall (28).

6. Container according to claim 1, characterized in that a reinforcement (12*a*, 12*b*) constituted by a thick rigid material plate is provided at each of the ends of the internal confinement enclosure (2) in order to distribute thereon the forces occurring on impact with a rigid obstacle.

7. Container according to claim 1, characterized in that the crushing zone ($\sigma$a) of the shock absorbing material (20) is ten to twelve times higher than the crushing zone ($\sigma$a) of the material (30) lining cap (24).

* * * * *

UNITED STATES PATENT AND TRADEMARK OFFICE

CERTIFICATE OF CORRECTION

PATENT NO. : 4,815,605

DATED : March 28, 1989

INVENTOR(S) : Brissier et al.

It is certified that error appears in the above-identified patent and that said Letters Patent is hereby corrected as shown below:

Column 1, line 16, "transporation" should read --transportation--.

Column 3, line 61, "22" should read --32--.

Signed and Sealed this

Twelfth Day of December, 1989

*Attest:*

JEFFREY M. SAMUELS

*Attesting Officer*

*Acting Commissioner of Patents and Trademarks*